United States Patent [19]

Ward et al.

[11] Patent Number: 4,977,037

[45] Date of Patent: Dec. 11, 1990

[54] SMOOTHER CONTINUOUS CAST STEEL BAR PRODUCT

[75] Inventors: George C. Ward; Thomas N. Wilson; Uday F. Sinha, all of Carrollton, Ga.

[73] Assignee: Southwire Company, Carrollton, Ga.

[21] Appl. No.: 831,127

[22] Filed: Feb. 21, 1986

Related U.S. Application Data

[60] Continuation of Ser. No. 311,703, Oct. 15, 1981, abandoned, which is a continuation of Ser. No. 111,423, Jan. 11, 1980, abandoned, which is a division of Ser. No. 860,657, Dec. 14, 1977, abandoned.

[51] Int. Cl.[5] ..... B22D 11/06; B22D 25/06

[52] U.S. Cl. ..... 428/577; 428/687; 148/320

[58] Field of Search ..... 428/687, 577; 148/31, 148/320; 164/482, 459

[56] References Cited

U.S. PATENT DOCUMENTS

| | | | |
|---|---|---|---|
| 3,503,161 | 3/1970 | Lang | 164/263 |
| 3,533,463 | 10/1970 | Hazelett | 164/433 |
| 3,623,535 | 11/1971 | Lenaeus | 164/482 |
| 4,042,009 | 8/1977 | Horstman et al. | 164/433 |
| 4,092,155 | 5/1978 | Dompas et al. | 164/433 |

FOREIGN PATENT DOCUMENTS 1608062 10/1920 Fed. Rep. of Germany .

OTHER PUBLICATIONS

Lyman, T., Ed; et al.; *Metals Handbook* 8th Edition, vol. 1: pp. 62, 282; vol. 5: 53, 178, 199, 230, TA 472 A3(1970).

Doyle, L. E.; *Manufacturing Processes and Materials for Engineers,* 2nd Edition; pp. 248–249 (1969).

Merriman, A. D.; *A Dictionary of Metallurgy,* p. 305; TN609 M47 (1958).

Mills, N. T. et al.; "A Look Inside Strand Cast Steel Slabs"; *Iron And Steelmaking,* pp. 187–191, (1977).

Hintz, O. et al.; "Recent Developments in Machine Scarfing of Continuous Cast and Rolled Steel"; *Iron and Steel Engineer,* pp. 68–71 (1/78).

Brimacombe, J. K. et al.; "Crack Formation in the Continuous Coating of Steel"; *Metallergical Transactions B,* pp. 489–505 (9/77).

Kimmel, G. L.; "Strand Casting Steel for Hot Forging and Cold Heading Applications", Roblin Steel Co., pp. 2–7 (1977).

Oberg, E.; *Machinery's Handbook,* Industrial Press 20th Edition, pp. 2381–2397 (1976).

*Primary Examiner*—John J. Zimmerman

*Attorney, Agent, or Firm*—George C. Myers, Jr.; Stanley L. Tate

[57] ABSTRACT

Disclosed herein is an improved new product and a process for its manufacture. The new product is a continuous cast steel bar having improved surface quality when compared to prior art continuous cast steel bars. The improved product is produced by means of a continuous casting machine of the known type having a rotating casting wheel with a peripheral groove which is closed along a portion of its length by a metal band.

30 Claims, 3 Drawing Sheets

SMOOTHER CONTINUOUS CAST STEEL BAR PRODUCT

CROSS-REFERENCE TO RELATED APPLICATIONS

This application is a continuation of application Ser. No. 311,703, filed on 10/15/81, now abandoned, which was a continuation of application Ser. No. 111,423, filed on 1/11/80, now abandoned, which was a division of Ser. No. 860,657, filed on 12/14/77, now abandoned.

BACKGROUND OF THE INVENTION

This invention relates to continuous casting of metals and pertains more particularly to methods and apparatus for the production of continuous lengths of steel bars which have such improved surface qualities that the bars are suitable for directly forming into a wrought product.

In the usual methods for the continuous casting of metals such as steel, the molten metal is poured into an open ended vertical mold. The mold chills the periphery of the metal and solidifies a skin or shell on the mold wall to define a strand which is withdrawn continuously from the bottom of the mold while molten metal is poured continuously into the top of the mold at a rate adjusted to equal the withdrawal rate. After issuing from the mold, the hot strand is cooled, for example, by water sprays directly on the semi-solid strand to form a fully solidified strand. The cooling applied to the strand after it issues from the mold is known in the art as secondary cooling and is sufficient to complete the solidification of the strand prior to any subsequent processing.

In most continuous casting installations, the axis of the mold is vertical and the strand issues vertically downward therefrom. After the strand is completely solidified, pieces of the desired length are severed from the moving strand. Because it is necessary that the strand be completely solidified before cutting, casting speeds have been limited by vertical height considerations. That is, it has been necessary to limit casting speeds in order to permit complete solidification to take place within reasonable vertical dimensions between the mold and the cutting station. Otherwise, plant construction costs become excessive.

In the casting of steel, these problems have been of particular concern because of the high temperature of the molten steel, and the long time required to completely solidify the strand. For example, in typical installations for the continuous casting of steel, a distance of seventy feet between the mold and the cutting station is not uncommon, and even this distance requires restriction of the casting speed to less than that which is theoretically possible.

In order to reduce the vertical height requirements, it has been proposed to cast the strand in a vertically disposed mold, then to cool the emerging strand in a vertically disposed secondary cooling zone in which the casting is supported by rollers. The strand is then bent toward the horizontal by pairs of pressure rollers. In such installations, the strand is bent through an arc of approximately 90° so that the bent strand becomes tangent to the horizontal. At the tangent point, the strand is rebent and straightened by pairs of pressure rollers, and it is then transported horizontally to a cutting station. This permits some reduction of machine height, but has not provided a satisfactory solution of the problem because a bending arc of relatively long radius is required. Even with a large radius, there is still difficulty in bending and rebending the solidified casting without cracking or otherwise damaging the casting.

A further reduction of height and overall length of casting machines has been achieved by making the mold cavity curved so that the strand emerges from the mold in curved condition conforming to the curved path. Molds with curved cavities, however, have not been completely satisfactory. Mold cavities are customarily provided with liners of copper because of its good heat conducting properties. The curved copper mold liners have higher fabricating and maintenance costs than straight copper liners for straight mold cavities. In addition, proper aligning of a mold with a curved cavity is more difficult than properly aligning of a mold with a straight cavity. However, the strand which emerges in straight condition from a straight mold cavity must then be bent into the curved path and this bending operation requires additional vertical space as compared with the vertical space requirement for machines having curved mold cavities. Thus, in known casting machines the benefits of conducting the strand along a curved path from the mold warrant the continued use of curved paths, but these benefits have been diminished by the above described problems with the molds.

In addition to efforts to reduce the vertical space required for continuous casting there has been a continuing effort to increase the casting speed. It is known that continuous relative motion between the casting and the mold impedes the transfer of heat from the solidifying casting to the mold wall and thus limits the casting rate. To date the most notable increase has been achieved by oscillating the mold along a short path in the casting direction as disclosed by Junghans in U.S. Pat. No. 2,135,183 (U.S. Class 164-83). For casting steel a usual amount of oscillation of the mold is about 1/10 to 1/30 the length of the mold, 1/16 to 2 inches, for example. In known constructions, molds having curved mold cavities are oscillated in an arc corresponding to the curvature of the path along which the strand is conducted from the mold. If, however, a mold having a straight cavity is used—to avoid the above-mentioned difficulty with curved mold passages—the strand must be conducted from the mold in a straight vertical line for a sufficient distance to avoid rubbing of the lower edge of the mold against the portion of the casting at the inside of its arcuate path. But this involves increasing the vertical space required. In addition, tests have shown that at higher casting speeds a strand cast in a straight mold cavity and then bent to follow a curved path from the mold tends to develop internal defects and surface cracks.

A much more serious problem, common to both straight and curved mold cavities, is one which arises as a direct consequence of increased casting rate, namely, the problem of obtaining satisfactory surface characteristics.

A universal characteristic of castings produced by a Junghans-type oscillating mold is the presence of oscillation marks or rings extending around the casting in the surface thereof. Due to friction between the advancing cast bar and the oscillating mold surface, axial stresses are imposed on the thin solidifying metal shell. These alternating stresses are thought to cause the observed surface cracks or other defects at intervals along the length of the casting usually in the form of rings around the entire circumference of the strand. These rings are spaced at distances equal to the total advance of the casting between successive strokes of the mold. That is, if the total advance of the casting (usually moving continuously at a constant rate) is two inches between the beginning of one retracting stroke of the mold and the beginning of the next succeeding retracting stroke, the rings will be found to be spaced at two inch intervals. Further, the width of the rings, i.e., the distance lengthwise of the casting over which these defects may be observed, varies depending on the conditions of the casting operation. With extreme care and operating at a low casting rate, the effects may be minimized, but in general, the width of the rings is related to the time of the retracting stroke of the mold. That is, if the return stroke consumes one-fourth of the time of a complete cycle, the rings will be formed to cover at least one-fourth of the surface of the cavity.

These rings are characterized by a roughened exterior surface of the cast bar, frequently with surface cracking, and frequently with evidence of "bleeding" i.e., the leaking of molten metal through a lesion in the formerly modified skin of the casting, with subsequent solidification of the leaking metal. The crystalline structure of the metal lying just under the rings is also irregular and disturbed.

In the case of non-ferrous metals, these effects have been undesirable, but not too serious. In many cases, despite the surface imperfections the castings could be rolled, extruded or otherwise processed without difficulty. In other cases a light scalping or other surface conditioning operation was sufficient to remove all objectionable surface imperfections. In the case of steel, however, such surface imperfections cannot be tolerated, and it is not economically feasible to remove the imperfections by scalping. Moreover, the economics of the continuous casting of steel demands a far greater casting rate than is customary or desirable in casting non-ferrous metals, and it has been found that the increased casting rate greatly magnifies the difficulty. Thus, in casting non-ferrous metals on this type of mold a casting rate of thirty to sixty inches per minute is usually adequate, and at these speeds, the surface imperfections are tolerable in non-ferrous metals. In casting steel, on the other hand, casting rates as high as two hundred inches per minute have already been successfully achieved with the Junghans-type process, but this success is tempered by the fact that at about these speeds and at greater speeds, the surface imperfections within the ring areas are often extremely bad. Between successive rings, the surface is usually good and the interior crystalline structure is acceptable.

From the theoretical point of view, therefore, the ideal form of mold for continuous casting would be a curved one of greatly extended length, but since as a practical matter this cannot exist, other devices have been utilized.

Thus, it has been proposed to use endless supports such as revolving drums, wheels and the like, or endless moving bands or endless chains of mold sections which join together to form a mold at the start of the solidification process and separate at its conclusion to release the solidified metal. Since the surfaces of such movable supports can remain stationary with respect to the metal during the solidification process, favorable conditions are provided for the solidification of metal with good crystalline structure and smooth surface characteristics. But while such methods offer some theoretical advantages, actual experience with them has been disappointing. Constructional and operating difficulties have provided so many obstacles to practical successful operation that such methods have made little or no headway in actual commercial operation.

Therefore, on balance, for the continuous casting of steel the use of oscillating molds with curved cavities has, up to the present, been considered the most satisfactory arrangement for reducing the height of the apparatus and for increasing the rate of casting, despite the problems with oscillating curved mold liners, described above.

Horizontal molds have been utilized heretofore for the continuous casting of aluminum and some other non-ferrous metals in machines in which the molten metal is introduced into a horizontal mold through a refractory feed spout which extends through the end wall of the mold. When casting aluminum, the feed spout is not wet by the molten aluminum and it remains clean as casting proceeds. However, when casting steel, and in particular, where it is desired to use an oscillating mold, this type of horizontal mold with a refractory feed spout cannot be employed. It has been found that steel wets the spout and solidifies around the spout. The solidified steel tends to build up a false tube extending the length of the mold, ultimately resulting in a breakout of molten metal at the exit end of the mold.

In addition, it is known that the position and direction of the inflowing stream of molten metal greatly affects the solidification process and therefore the resulting product.

A horizontal casting mold usually necessitates a horizontal inflowing stream of molten metal which washes against metal which is already beginning to solidify on the mold wall. This causes the solidifying metal to remelt, often resulting in bleeding of molten metal to the outside of the casting. If the velocity of the inflowing metal is high or is such to cause turbulence in the pool of molten metal, bubbles of gas and particles of oxides, slag, or dirt floating on the surface of the molten metal may be entrapped, causing holes and inclusions in the casting, sometimes even resulting in gross porosity or "piping" in the casting. At the very least, a horizontally solidified bar exhibits internal variations across its section due to the effects of gravity. For example trapped gasses and light particles tend to float upwards toward the topside of the bar. Thus the center of the bar may be sound but an area of porosity or of inclusions is located near one edge of the bar. This off-center distribution of defects is often more serious than center defects since it causes unpredictable variations in subsequent processing, e.g., hot-rolling into rod. Consequently, it is desirable that the pool of molten metal be open or exposed at the top so that trapped gasses and other impurities can avoid being trapped into the solidifying bar, or at least confined to the center where they are least harmful.

When a continuous casting of rectangular cross section initially solidifies inside a typical horizontal mold, the (usually) larger top and bottom surfaces are necessarily exposed to more rapid cooling. The resulting shrinkage effects cause these surfaces, especially the top, to pull away from the walls of the mold before moving very far from the molten pool thus slowing the initially rapid cooling. Since the several edges and surfaces do not all shrink uniformly, the cooling rates and therefore temperatures, stresses, and thickness of the frozen shell all differ from one surface to another. These drawbacks become more pronounced at higher casting rates and as the casting continues to move through the mold, bright and dark areas appear on the slab as it issues from the mold. The bright areas often indicate high temperature locations where remelting of the once frozen shell can occur. Remelting occurs due to the transfer of heat from the still hot interior of the bar. At these points of weakness, the stresses in the frozen shell produce cracks which can cause breakouts or other surface defects.

Moreover, the unequal stresses have another undesirable consequence, namely that of causing a type of geometrical distortion of the cast bar known as rhombic distortion which is a nuisance in subsequent processing of the casting.

SUMMARY OF THE INVENTION

It is, therefore, a primary object of the invention to provide a novel continuous cast steel bar having a novel degree of surface smoothness when compared to prior art continuous cast steel bars.

More particularly, it is an object of this invention to provide a cast steel bar having a novel degree of surface smoothness and, at that, producing same by a much faster method of continuously casting than previously though possible by those of ordinary skill in the art. It is also an object of this invention to provide a forging quality steel bar which is suitable for directly rolling into wrought products.

Now in order to implement these and still further objects of the invention, which will become more readily apparent as the description proceeds, a preferred method of producing the cast steel bar of our invention is manifested by casting steel into a mold formed by a peripheral groove in a rotating casting wheel and a band which seals a length of the groove.

In accordance with prevailing practice, the mold is preferably made of a metal of high thermal conductivity, such as copper alloy, and the mold is chilled by directly spraying coolant onto the mold or by circulating coolant, such as cold water, therethrough.

The mold groove may be of various shapes, as desired, in transverse cross section, as for example, semicircular, square or rectangular. However, it has been found advantageous to use a trapezoidal cross-sectional shape having small (7° to 14°) relief angles on the sides and having a width to depth ratio of 2 to 1 or less.

In casting, the molten steel is cast into the mold and is uniformly chilled by withdrawal of heat through the mold walls to form a thin peripheral skin of solidified metal surrounding the molten metal within. The rate of withdrawal of heat is controlled with relation to the casting speed, by regulation of the rate of circulation of the mold coolant, or otherwise, so that the temperature of the exterior surface of the peripheral skin of solidified metal as it emerges from the mold does not exceed about 2500° F. but is not less than about 2000° F. and the thickness of the skin is sufficient to resist the ferrostatic head pressure of the molten core.

The emerging partially solidified strand is then conducted along a supporting passageway to a substantially horizontal cooling zone for final cooling and solidification.

The supporting passageway may be formed by a series of members which have surfaces which engage and support the strand. The members may have provisions for circulation of coolant therein. Additionally, such members may have provision for direct application of a quantity of coolant to the strand through the walls of the passageway in order to lubricate the passageway to facilitate the movement of the strand therealong.

As the strand moves along the supporting passageway, it is important that the thin skin of solidified metal which is formed in the mold be maintained in order to prevent remelting by absorption of heat from the molten interior.

As the strand emerges from the supporting passageway, it is conducted through a third cooling zone wherein it is chilled to complete the solidification thereof.

While the strand is being conducted through the third cooling zone, it is supported and maintained until solidification is completed. For example, the strand may be supported from below on a series of closely spaced parallel rollers whose axes lie in a common plane. As the strand emerges from the supporting passageway it is received by said rollers, or other supporting structure, on which it may be transported to a cutting station or rolling mill while it is being chilled.

Preferably, the chilling in the third cooling zone is by uniform application of coolant to the surfaces of the strand, as by water sprays directed against the surfaces.

It should be apparent that the preferred method of producing our cast steel bar having a novel degree of surface smoothness is significantly different from the commercially proven Junghans-type (Concast-type) prior art method of forming a steel cast bar. Most importantly, there is never any relative movement between the mold and the solidifying molten steel as occurs in all known previous steel strand casting methods of this type, thus there is no possibility that the thin shell of solidified metal will be torn open to cause breakouts, bleeding or other surface defects.

Furthermore, in our casting arrangement described above, the cast bar, with increasing shell thickness, follows a path of increasing radius until it becomes horizontal. Thus little or no mechanical stress in the reverse direction is forced on the cast bar while it is still fragile.

Another important difference is that this invention provides for varying the heat-transfer rate in coordination with the solidification process. For example, since the molten metal is continually introduced into a cold wheel, the heat transfer rate is very high causing rapid cooling while later the heat transfer rate is lower, allowing an orderly growth of the solidification front. A rapid cooling rate is desirable when casting steels of lower carbon content, e.g., 0.08% by weight while a slower cooling rate may be desirable when casting higher carbon steels, such as 0.8% by weight.

The resulting continuous length of cast bar has a much better surface quality then steel bars cast by prior art methods at similar casting rates, which here may easily exceed 240 inches per minute and may be as high as 350 inches per minute or higher. The surface is free from injurious cracks, laps or seams normally associated with oscillation marks and therefore said cast bar is characterized by having a smooth surface free of oscillation marks and other injurious surface defects. In addition, due to the unique casting process and fast casting rate, the as-cast bar has a thinner oxide scale on the surface than prior art bars.

BRIEF DESCRIPTION OF THE DRAWINGS

The invention will now be explained in more detail with respect to the accompanying drawings in which.

These figures and the following detailed description disclose a specific embodiment of the invention. However, it will be understood that the present invention is not limited to the exact details disclosed herein since it may be embodied in other equivalent forms without departing from the inventive concept.

DETAILED DESCRIPTION OF THE INVENTION

Figure 1:
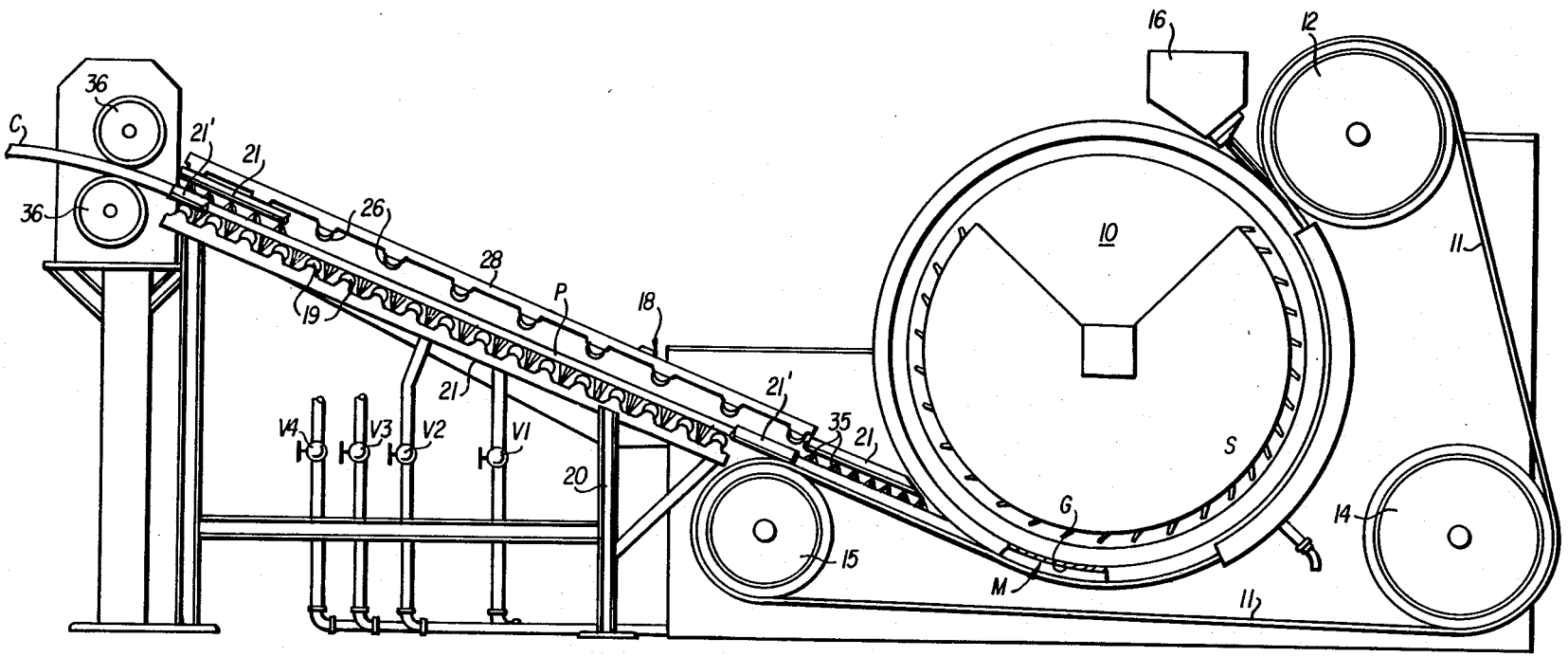
FIG. 1 is a schematic diagram illustrating one example of apparatus suitable to practice the invention, this apparatus comprising a casting machine having a rotatable casting wheel containing a peripheral groove and endless metallic band which seals a length of the groove.

Referring now in more detail to the drawing, in which like numerals of reference illustrate like parts throughout the several views, FIG. 1, shows casting wheel 10 having a groove in its periphery and an endless flexible band or belt 11 positioned against a portion of its periphery by three band support wheels 12, 14, and 15. The band support wheel 12 is positioned near that point on the casting wheel 10 wherein molten steel is discharged by a pouring pot or tundish 16 into a mold M formed by the band 11 and a peripheral groove G around the casting wheel 10. The band support wheel 15 is positioned tangentially outwardly from that point on the casting wheel 10 at which partially solidified metal is discharged from the casting wheel 10.

Positioned outwardly of the band support wheel 15 is an extended cooling section 18 which serves as a cooling means for receiving the partially solidified cast steel bar from the casting wheel 10 and controls the cooling of the steel bar for the complete solidification thereof. The cooling section 18 includes a plurality of support rolls 19 supported by frame 20 of the cooling section 18 and a plurality of manifolds 21, 21'; the manifolds 21 being positioned above and below the path P of the metal through the cooling section 18 and the manifolds 21' being positioned at the sides of the path P of the bar through the cooling section 18.

Support rolls 19 may either be driven or non-driven since the incline of rolls 19 from the bottom of the casting wheel is gradual and in most situations, the longitudinal compressive strength of the hot steel bar emerging from the casting wheel is sufficient to drive the metal up the incline without substantial hazard of the metal's collapsing. However, when it is desired to assist the movement of the cast bar up the incline of path P, rolls 19 can be positively driven. As seen in FIG. 1, the rolls 19 are rotated counterclockwise so that bar C resting thereon will be carried away from the casting wheel 10. A plurality of upper rolls 26 are mounted above the path of cast bar C through the cooling section 18 and are positionable to retain the bar in path P. Side guide walls may be positioned on opposite sides of path P to also serve and retain the bar in its path.

The manifolds 21 and 21' are so positioned that all sides of cast bar C are uniformly cooled and each manifold 21, 21' can be independently controlled through valves V1, V2, V3 and V4 to selectively control the cooling rate of each side of metal C. The cooling fluid, usually water, is discharged onto the hot cast bar, through a plurality of conventional nozzles (not shown).

As cast bar C exits the cooling section 18, it passes to a rolling mill (not shown) or other subsequent processing equipment. If desired, the bar can be received between a pair of pinch rolls 36 of conventional design to assist its movement.

Figure 2:
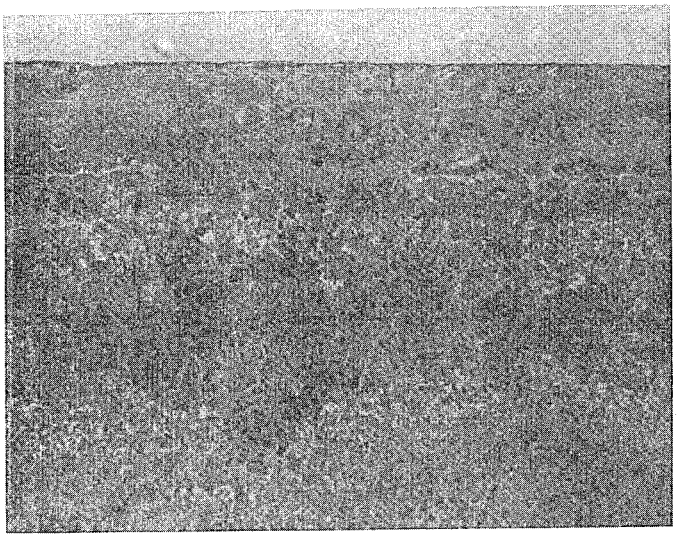
FIG. 2 is a photograph of a length of the present continuous cast bar showing the smooth surface thereof.

The bar shown in FIG. 2 was produced by casting steel having about 0.60% carbon, 0.75% manganese, and 0.017% sulphur and phosphorous into the wheel while at a temperature of between about 2700° and 2800° F. The bar exited the wheel at about 300 inches per minute at a temperature of between about 2100° to 2200° F. and was about 75% to 80% solidified and had a surface scale less than 0.005 inches (5000 microinches) thick.

The cast bar is characterized by having a smooth surface free from oscillation marks or other major defects. When casting steel having a carbon content of between about 0.18% and 0.66% by weight and less than 0.03% by weight of sulphur and phosphorous, it has been found that the cast bar of the present invention has a surface which is usually smootner than about 1,000 microinches (when measured with a profiling instrument, one common method of measuring surface finish according to ANSI standard B46.1) even at casting speeds higher than 240 inches per minute. That is, the average deviation from a perfectly flat surface is such that the cumulative total depth of the cracks or other imperfections (hereinafter "surface irregularities") divided by the number of such surface irregularities, is less than about 1000 microinches per linear inch. Said another way, the surface roughness measurement may be obtained from a magnified profile of the surface contour by measuring the deviations, from a theoretical mean surface, at a number of points along the contour profile and then dividing the total cumulative deviation by the number of points measured. Alternately, the surface roughness measurement may be obtained directly by reading the display on the types of instruments known in the art (see ANSI B46.1) which electronically integrate the surface profile and continuously display the average roughness. On the product of our invention these methods of measuring will yield a value of less than about 0.001 inches (1000 microinches).

Also of importance is the average defect depth or flaw depth, which is less than about 0.1 inches (100,000 microinches) and usually less than 0.01 inches (10,000 microinches) deep.

Figure 3:
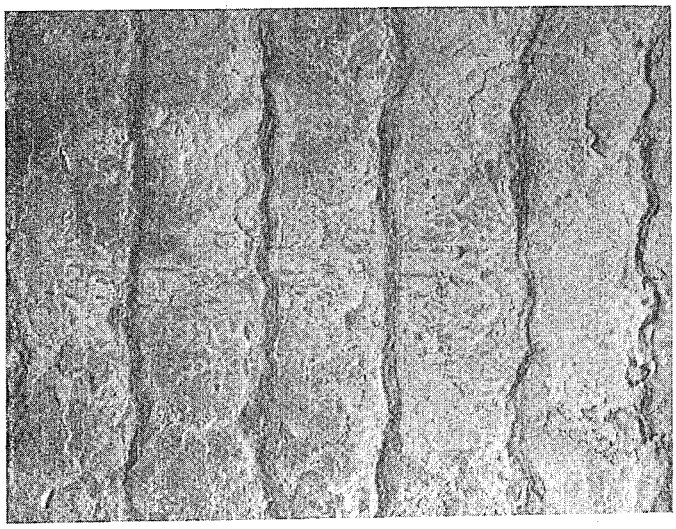
FIG. 3 is a photograph of a length of commercially produced Concast-type prior art continuous cast bar showing typical oscillation marks causing a very rough surface.
Figure 4:
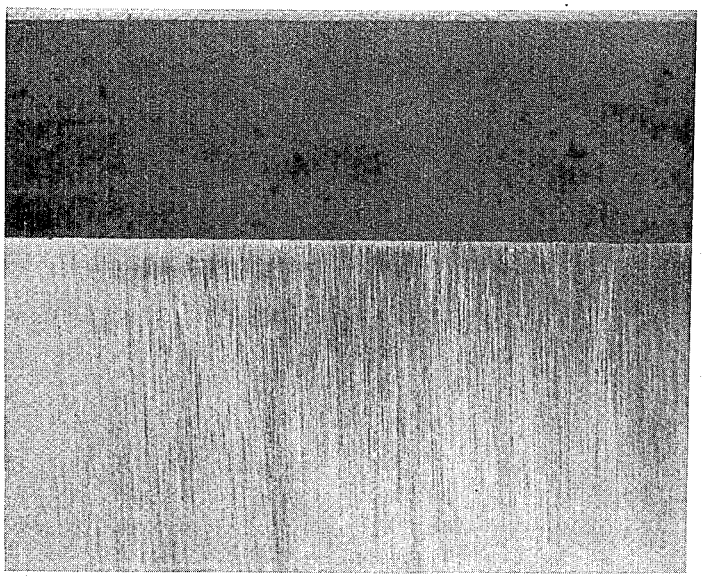
FIG. 4 is a cross-sectional view of the present cast bar showing the very smooth profile thereof.
Figure 5:
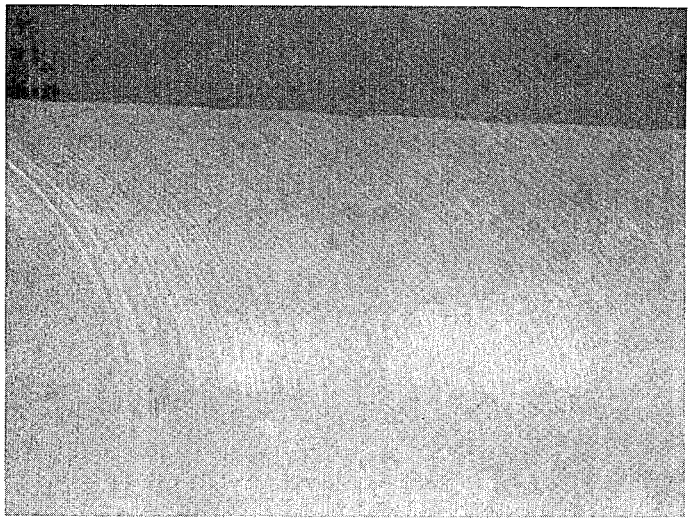
FIG. 5 is a cross-sectional view of the bar shown in FIG. 3, again showing the rough surface profile of the prior art cast bar.

The cast bar shown in FIG. 3 shows severe surface defects due to the aforementioned oscillation marks. This sample was produced with a commercial prior art Concast-type process utilizing a short, vertical, open ended mold of the reciprocating type. The surface defects are more than 0.1 inches (100,000 microinches) deep and the average surface roughness measurement is more than 1000 microinches per inch.

It will be understood by those skilled in the art that many variations may be made in the embodiment chosen herein for the purpose of illustrating the present invention without departing from the scope thereof as defined by the appended claims. For example, applicants have reported herein only a representative sampling of the infinite number of steel compositions which may be cast according to the present invention.

What is claimed is:

1. A continuously cast steel bar cast at a rate greater than 240 inches per minute, said bar having an as-cast surface roughness measurement of less than about 1000 microinches; that is, the cumulative total depth of the finer irregularities in the surface divided by the number of such surface irregularities is less than about 0.001 inches (1000 microinches) and the average depth of any surface flaws or other such defects in said cast steel bar is less than about 0.10 inches (100,000 microinches).

2. A continuously advancing endless moving surface-type cast steel bar continuously advancing at a rate greater than 240 inches per minute, said bar having an as-cast surface roughness measurement of less than about 1000 microinches; that is, the cumulative total depth of the finer irregularities in the surface divided by the number of such surface irregularities is less than about 0.001 inches (1000 microinches) and the average depth of any surface flaws or other such defects in said cast steel bar is less than about 0.10 inches (100,000 microinches).

3. A continuously cast steel bar having an as-cast surface roughness measurement of less than about 1000 microinches; that is, the cumulative total depth of the finer irregularities in the surface divided by the number of such surface irregularities is less than about 0.001 inches (1000 microinches) and the average depth of any surface flaws or other such defects in said cast steel bar is less than about 0.10 inches (100,000 microinches);

said steel bar being produced by a method comprising:

(a) continuously casting molten steel at a rate greater than 240 inches per minute into a continuously advancing closed mold formed by at least one endless moving surface in conjunction with other sealing surfaces so as to form a closed mold, (b) cooling the mold thereby causing the molten steel to begin to solidify forming a skin of skin of solid metal about a molten core, (c) withdrawing the at least partially solidified cast bar from the exit of the closed portion of the mold, and (d) further cooling the cast steel bar by at least one of direct and indirect coolant sprays thereon.

4. A continuously cast steel bar as defined in claim 3, wherein step (a) is performed in a wheel-band type continuous casting machine.

5. A continuously cast steel bar as defined in either of claims 3 or 4, wherein the bar is of forging quality so that it may be directly hot-worked into a wrought product without any intermediate surface cleaning.

6. A continuously cast steel bar as defined in either of claims 3 or 4, said bar having a carbon content of between about 0.08 and 0.80 weight percent.

7. A continuously cast steel bar as defined in claim 6, said bar having a carbon content of between about 0.18 and 0.66 weight percent.

8. A continuously cast steel bar as defined in either of claims 3 or 4, wherein said surface roughness measurement characterizes each and every surface of the cast bar.

9. A continuously cast steel bar as defined in either of claims 3 or 4, said bar having a surface oxide scale thickness of less than 0.005 inches (5,000 microinches) thereby achieving sufficient surface quality so that said cast bar can be directly hot-formed into a wrought product without any intermediate surface cleaning.

10. A continuously cast steel bar as defined in either of claims 3 or 4, wherein the average depth of any surface flaws or other such defects is less than about 0.03 inches (30,000 microinches).

11. A continuously cast steel bar as defined in either of claims 3 or 4, wherein the average depth of any surface flaws or other such defects is less than about 0.02 inches (20,000 microinches).

12. A continuously cast steel bar as defined in either of claims 3 or 4, wherein the average depth of any surface flaws or other such defects is less than about 0.01 inches (10,000 microinches).

13. The new continuously cast steel product produced by the old process steps of:

(a) casting molten metal at a rate greater than 240 inches per minute into a continuously advancing closed mold formed by at least one endless moving surface in conjunction with other sealing surfaces so as to form a closed mold, (b) cooling the mold thereby causing the molten metal to begin to solidify forming a skin of solid metal about a molten core, (c) withdrawing the at least partially solidified cast bar from the exit to the closed portion of the mold, and (d) cooling the cast bar by at least one of direct and indirect coolant sprays thereon;

wherein said new product is a cast steel product characterized by:

(e) having a surface free of injurious cracks, laps, and seams, and (f) having a surface roughness measurement of less than about 1000 microinches; that is, the cumulative total depth of the finer irregularities in the surface divided by the number of such surface irregularities is less than about 0.001 inches (1000 microinches) and the average depth of any surface flaws or other such defects in said cast steel product is less than about 0.10 inches (100,000 microinches).

14. The product of claim 13 further characterized by:

(g) being forging quality steel bar stock having sufficient surface quality so that the steel cast bar may be directly hot-worked into a wrought product without any intermediate surface cleaning.

15. The product of claim 13 being further characterized by being a steel alloy having a carbon content of between about 0.08 and 0.80 weight percent.

16. The product of claim 15 being further characterized by being a steel alloy having a carbon content of between about 0.18 and 0.66 weight percent.

17. The product of claim 13 wherein said limitations characterize each and every surface of the cast bar.

18. The product of claim 13 being further characterized by having a surface oxide scale thickness of less than 0.005 inches (5000 microinches) thereby achieving sufficient surface quality so that said cast bar can be directly hot-formed into a wrought product without any intermediate surface cleaning.

19. The product of claim 13 wherein the average depth of any surface flaws or other such defects is less than about 0.03 inches (30,000 microinches).

20. The product of claim 13 wherein the average depth of any surface flaws or other such defects is less than about 0.02 inches (20,000 microinches).

21. The product of claim 13 wherein the average depth of any surface flaws or other such defects is less than about 0.01 inches (10,000 microinches).

22. The new continuously cast metal product produced by the old process steps of:

(a) casting molten metal at a rate greater than 240 inches per minute into a closed mold formed by a peripheral groove in a rotating casting wheel and a band which seals said groove over a portion of its length, (b) cooling the mold thereby causing the molten metal to begin to solidify forming a skin of solid metal about a molten core, (c) withdrawing the at least partially solidified cast bar from the exit to the closed portion of the mold, and (d) cooling the cast bar by direct and/or indirect impingement of coolant sprays thereon;

wherein said new product is a cast steel product characterized by:

(e) having a surface free of injurious cracks, laps, and seams, and, (f) having a surface roughness measurement of less than about 1000 microinches; that is, the cumulative total depth of the finer irregularities in the surface divided by the number of such surface irregularities is less than about 0.001 inches (1000 microinches) and the average depth of any surface flaws or other such defects in said cast steel product is less than about 0.10 inches (100,000 microinches).

23. The product of claim 22 further characterized by:

(g) being forging quality steel bar stock having sufficient surface quality so that the steel cast bar may be directly hot-worked into a wrough product without any intermediate surface cleaning.

24. The product of claim 22 being further characterized by being a steel alloy having a carbon content of between about 0.08 and 0.80 weight percent.

25. The product of claim 24 being further characterized by being a steel alloy having a carbon content of between about 0.18 and 0.66 weight percent.

26. The product of claim 22 wherein said limitations characterize each and every surface of the cast bar.

27. The product of claim 22 being further characterized by having a surface oxide scale thickness of less than 0.005 inches (5000 microinches) thereby achieving sufficient surface quality so that said cast bar can be directly hot-formed into a wrought product without any intermediate surface cleaning.

28. The product of claim 22 wherein the average depth of any surface flaws or other such defects is less than about 0.03 inches (30,000 microinches).

29. The product of claim 22 wherein the average depth of any surface flaws or other such defects is less than about 0.02 inches (20,000 microinches).

30. The product of claim 22 wherein the average depth of any surface flaws or other such defects is less than about 0.01 inches (10,000 microinches).

* * * * *